United States Patent [19]

Eickel et al.

[11] 4,177,380

[45] Dec. 4, 1979

[54] METHOD AND APPARATUS FOR MAKING AND DEVELOPING IONOGRAPHIC IMAGES OF X-RAYED OBJECTS

[75] Inventors: Rolf Eickel; Alfred Rheude, both of Munich, Fed. Rep. of Germany

[73] Assignee: Agfa-Gevaert Aktiengesellschaft, Leverkusen, Fed. Rep. of Germany

[21] Appl. No.: 867,494

[22] Filed: Jan. 6, 1978

[30] Foreign Application Priority Data

Jan. 28, 1977 [DE] Fed. Rep. of Germany ..... 2703426

[51] Int. Cl.[2] ..... G03G 13/00; G03G 15/00

[52] U.S. Cl. ..... 250/315.2; 250/315.1

[58] Field of Search ..... 250/315, 315 A, 413; 355/10, 14; 118/648, 660; 427/17; 358/111, 280, 296, 300

[56] References Cited

U.S. PATENT DOCUMENTS

| | | | |
|---|---|---|---|
| 3,949,222 | 4/1976 | Lewis | 250/315 A |
| 3,974,385 | 8/1976 | Grim | 250/413 |
| 4,050,806 | 9/1977 | Miyakawa et al. | 355/10 |

*Primary Examiner*—Craig E. Church
*Assistant Examiner*—Thomas P. O'Hare
*Attorney, Agent, or Firm*—Peter K. Kontler

[57] ABSTRACT

Latent images which are formed on dielectric receptor sheets during exposure to object-modulated primary and stray X-rays, while the sheets dwell in the interelectrode gap of an ionography imaging chamber, are developed in an electrophoretic unit which neutralizes the effect of stray radiation upon the receptor sheets so that the developed visible images are reproductions of those portions of latent images which are formed as a result of exposure to primary radiation. The neutralizing involves ascertaining the intensity of stray radiation behind the imaging chamber by resorting to one or more dosimeters and one or more rasters or analogous devices which absorb stray radiation, and applying to the electrodes of the developing unit a reverse potential which is proportional to the intensity of stray radiation. Alternatively, the intensity of stray radiation can be ascertained empirically and the reverse potential is selected by hand, depending on the density and thickness of the object.

18 Claims, 3 Drawing Figures

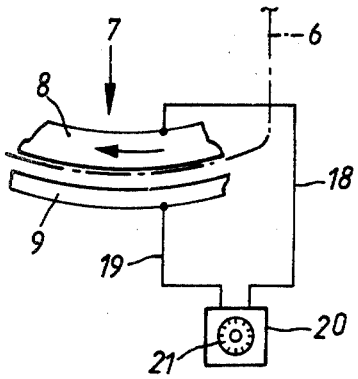
Fig. 2
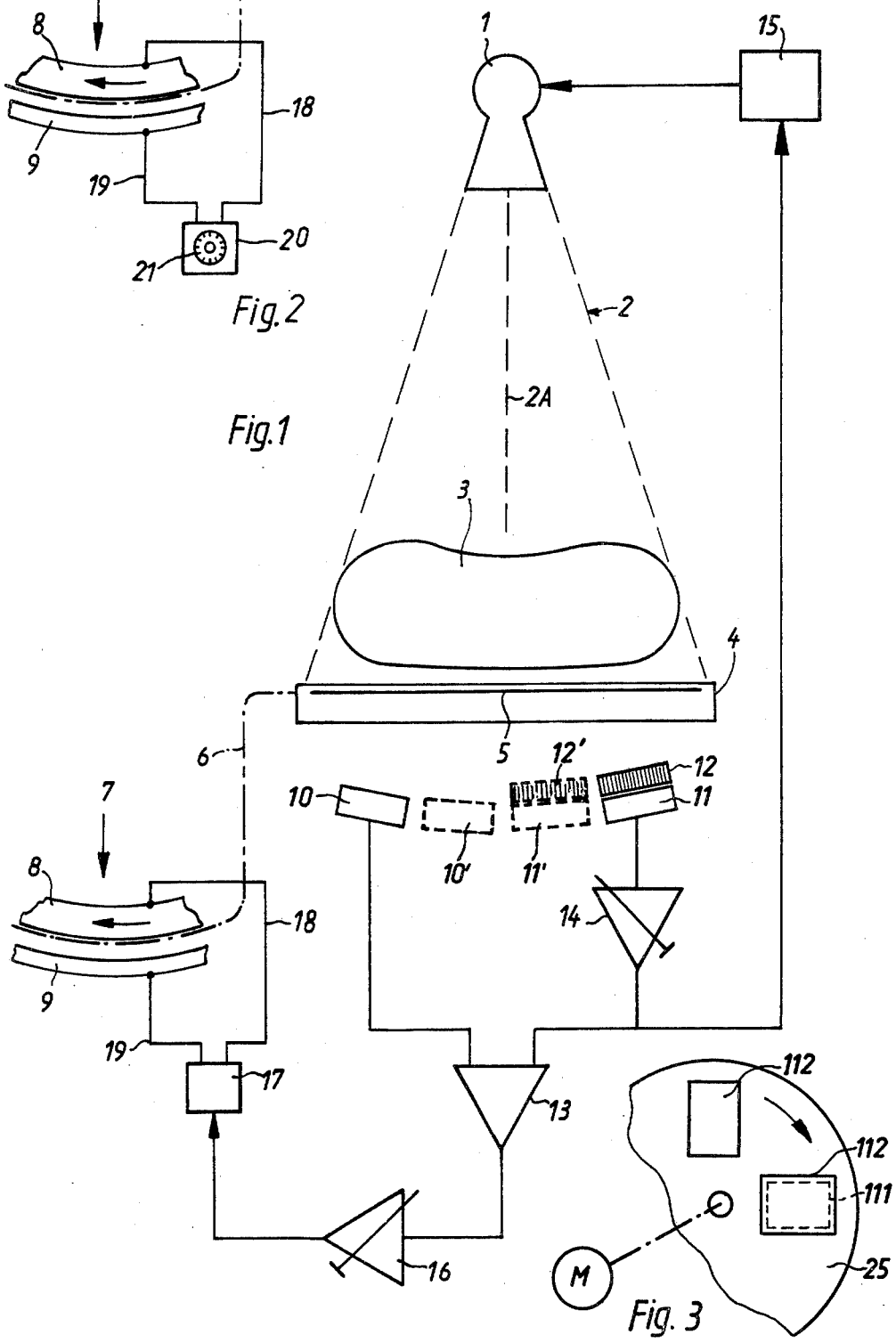
Fig. 1
Fig. 3

METHOD AND APPARATUS FOR MAKING AND DEVELOPING IONOGRAPHIC IMAGES OF X-RAYED OBJECTS

BACKGROUND OF THE INVENTION

The present invention relates to a method and apparatus for making and developing ionographic images of X-rayed objects. More particularly, the invention relates to improvements in a method and apparatus for reducing or eliminating the effects of stray radiation on the quality of visible images which are obtained as a result of development of latent images on dielectric receptor sheets of the type used in ionography imaging chambers.

It is well known that stray radiation which develops on exposure of an object to X-rays adversely influences the contrast of the latent image, i.e., of a pattern of electrostatic charges on a dielectric receptor sheet in the gas-filled interelectrode gap of an ionography imaging chamber which is located in the path of X-rays that have penetrated through the object. Attempts to reduce or eliminate the effects of stray radiation upon the quality of the latent image include the provision of rasters which are placed between the object and the imaging chamber and serve to absorb stray radiation while permitting primary radiation to pass therethrough and to reach the receptor sheet in the interelectrode gap. Such rasters are also used in radiographic apparatus wherein the object-modulated X-rays produce an image on photographic film. A drawback of rasters is that, in addition to absorbing stray radiation, they also absorb a high percentage (approximately 50 percent) of primary radiation. Consequently, the dose of X-rays to which the object is exposed must be increased accordingly, i.e., by a value corresponding to the absorption factor of the raster. This is highly undesirable in certain fields of radiography, especially when the object to be exposed to X-rays is a selected part of a patient's body. Another serious drawback of rasters is their extremely high cost, especially when the size of a raster matches the size of the receptor sheet (this is the customary way of selecting the size of conventional media which absorb stray radiation).

OBJECTS AND SUMMARY OF THE INVENTION

An object of the invention is to provide a relatively simple and inexpensive method of eliminating or greatly reducing the effects of stray radiation upon the quality of developed images of X-rayed objects.

Another object of the invention is to provide a method which can be practiced without exposing the object to high doses of radiation.

A further object of the invention is to provide a method which insures the making of X-ray images with pronounced contrast.

An additional object of the invention is to provide a novel and improved apparatus for the practice of the above outlined method.

Another object of the invention is to provide an apparatus which can reduce or eliminate the effects of stray radiation upon the quality of object-modulated X-ray images in a simple, space saving and inexpensive way.

An ancillary object of the invention is to provide novel and improved means for eliminating or reducing the effects of that part of the electrostatic charge pattern on a dielectric receptor sheet which is attributable to the fact that the dielectric sheet was exposed to primary as well as undesirable stray radiation during X-raying of an object.

A further object of the invention is to provide an apparatus which can eliminate or reduce the effects of stray radiation upon visible images of X-rayed objects in spite of the fact that it need not employ large rasters or analogous non-selective radiation absorbing devices.

Another object of the invention is to provide an apparatus which, as a result of absence of rasters between the object and the receptor sheet, can furnish more satisfactory images than heretofore known apparatus.

One feature of the invention resides in the provision of a method of making and processing latent images of X-rayed objects on dielectric receptor sheets which are confined in the gas-filled interelectrode gap of an ionography imaging chamber during exposure to object-modulated X-rays including primary radiation and stray radiation. The method comprises the steps of exposing a receptor sheet to object-modulated X-rays whereby the stray radiation causes the formation of a first electrostatic charge pattern and the primary radiation causes the formation of a second electrostatic charge pattern which is superimposed upon the first pattern (such patterns together constitute the latent image on the receptor sheet), and neutralizing the effect of the first charge pattern (i.e., the effect of stray radiation upon the quality of the latent image) during processing of the receptor sheet. Such processing may include electrophoretic conversion of the latent image into a visible image between spaced-apart electrodes in the presence of toner particles; the neutralizing step then comprises applying to the electrodes a reverse potential which is at least approximately proportional to the intensity of stray radiation. For example, the neutralizing step may include the application of reverse potential which is selected by hand (e.g., on the basis of empirically obtained data furnished by the manufacturer of the apparatus and taking into consideration the thickness and/or density of the object) and is at least approximately proportional to the intensity of stray radiation.

Alternatively, one can resort to more accurate determination of the required reverse potential by taking advantage of the fact that portions of stray radiation and primary radiation penetrate through and beyond the imaging chamber. Such method may comprise the additional steps of measuring the intensity of the just mentioned portion of stray radiation and producing a signal which is proportional to the measured intensity of such portion of stray radiation (the signal is also proportional to the total amount of stray radiation which reaches the receptor sheet). The neutralizing step then includes utilizing the signal to eliminate the effect of the first charge pattern upon the quality of visible image into which the latent image is converted in the course of processing.

The intensity of that portion of stray radiation which has penetrated through and beyond the ionography imaging chamber can be ascertained as follows: The apparatus for the practice of the method is equipped with one or more dosimeters and suitable means for absorbing stray radiation (together with a percentage of primary radiation) in the path of radiation which has penetrated through and beyond the imaging chamber. The dosimeter or dosimeters measure the combined intensity of the aforementioned portions of primary radiation and stray radiation as well as the intensity of the aforementioned portion of primary radiation to produce a signal which is proportional to the difference between the measured intensities (such signal is also proportional to the intensity of stray radiation). The signal is then utilized in the course of the neutralizing step to eliminate the effect of the first charge pattern upon the quality of the visible image into which the latent image is converted during processing.

The method preferably further comprises the step of generating a second signal which is indicative of the intensity of the measured portion of primary radiation and can be amplified to denote the intensity of primary radiation. Such second signal can be generated by the aforementioned dosimeter alone or in combination with an amplifier which compensates for the absorption of some primary radiation by the absorbing means (e.g., a suitable raster). The second signal is then used to determine the quantity of radiation to which the object is exposed. In other words, the aforementioned dosimeter can serve as a component of the means for ascertaining the intensity of stray radiation in order to allow for accurate neutralization of the effect of stray radiation upon the quality of the latent image and also as a means for determining the necessary dose of X-rays.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a diagrammatic view of an apparatus which embodies one form of the invention;

FIG. 2 is a fragmentary diagrammatic view of a portion of a modified apparatus; and FIG. 3 is a fragmentary plan view of certain components in a further apparatus.

DESCRIPTION OF THE PREFERRED EMBODIMENTS

Referring to FIG. 1, there is shown a radiographic apparatus which comprises a source 1 of X-rays. The rays 2 issuing from the source 1 impinge upon and are partially absorbed by an object 3 which is located in front of an ionography imaging chamber 4, e.g., a chamber of the type disclosed in commonly owned U.S. Pat. No. 4,021,668 granted May 3, 1977 to Josef Pfeifer et al. Those rays which reach the dielectric receptor sheet 5 in the gas-filled interelectrode gap of the imaging chamber 4 include primary radiation and stray radiation. Such radiations produce on the receptor sheet 5 a latent image, i.e., overlapping patterns of electrostatic charges, whose contrast is adversely influenced by stray radiation. When the exposure is completed, the receptor sheet 5, with the latent image thereon, is withdrawn from the interelectrode gap and is transported to an electrophoretic developing unit 7 along a path 6 which is indicated by a phantom line. The means for transporting exposed receptor sheets 5 along such path may be of the type disclosed in commonly owned U.S. Pat. No. 4,061,915 granted Dec. 6, 1977 to Josef Pfeifer et al. A suitable developing unit is disclosed in German Offenlegungsschrift No. 1,513,292. The unit 7 comprises a rotary drum-shaped electrode 8 which is driven to rotate in the direction indicated by arrow and a complementary second electrode 9. The latent image is converted into a visible image during transport of the sheet 5 between the electrodes 8 and 9. The rear side of the sheet 5 is adjacent to the convex side of the electrode 8 and the image bearing side of the sheet is contacted by a suspension of toner particles which adhere to the sheet in a pattern corresponding to the charge pattern constituting the latent image.

The imaging chamber 4 is installed between the source 1 and two identical ionization chambers 10, 11 which are disposed mirror symmetrically with respect to the central ray 2A issuing from the source 1. The chambers 10 and 11 face the source 1. A small raster 12 which absorbs stray radiation (or an equivalent radiation absorbing device, e.g., a multiple-hole collimator which is focused upon the source 1) is placed in front of the ionization chamber 11. The output of the ionization chamber 10 transmits a signal (denoting the combined intensity of those portions of primary and stray radiation which have penetrated through and beyond the imaging chamber 4) to one input of a subtracting circuit here shown as a differential amplifier 13 whose other input receives a signal from the output of the ionization chamber 11 via adjustable amplifier 14. The signal which is amplified at 14 denotes the intensity of that portion of primary radiation which has penetrated through and beyond the imaging chamber; such signal is further transmitted to a control circuit 15 which regulates the dose of X-rays to which the object 3 is exposed during an imaging operation.

The signal which is transmitted by the differential amplifier 13 is amplified by an adjustable amplifier 16 and is transmitted to an adjustable source 17 of potential for the electrodes 8 and 9 of the developing unit 7. The connections between the poles of the energy source 17 and the electrodes 8 and 9 respectively comprise conductor means 18 and 19.

The operation is as follows:

The intensity of voltage signal at the output of the ionization chamber 10 is indicative of the combined intensity of those portions of primary and stray radiation which have penetrated through and beyond the imaging chamber 4. This ionization chamber, as well as the chamber 11 is or may constitute a suitable dosimeter. The intensity of voltage signal at the output of the ionization chamber 11 is indicative of that portion of primary radiation which has penetrated through and beyond the chamber 4 because the stray radiation is intercepted by the absorbing device 12. The provision of amplifier 14 is desirable because the device 12 absorbs stray radiation as well as a certain percentage of primary radiation, i.e., the amplification factor of 14 matches the absorption factor of the device 12. In other words, the difference between the intensities of voltage signals which are transmitted to the two inputs of the differential amplifier 13 is indicative of the intensity of stray radiation.

As mentioned above, the signal at the output of the amplifier 14 is further transmitted to the control circuit 15 which disconnects or deactivates the source 1 when the object 3 is exposed to a requisite quantity of X-rays, i.e., when the latent image on the receptor sheet 5 is satisfactory. The construction and mode of operation of such control circuits are well known in this art.

The signal which is transmitted by the output of the differential amplifier 13 (such signal is proportional to the intensity of stray radiation issuing from the object 3 and impinging upon the imaging chamber 4) is amplified at 16 prior to transmission to the energy source 17. This signal causes the source 17 to establish between the electrodes 8, 9 of the developing unit 7 a reverse potential whose intensity is analogous to the intensity of signal at the output of the amplifier 13. The applied potential compensates for (i.e., it neutralizes) that percentage of electrostatic charge on the receptor sheet 5 which is attributable to the influence of stray radiation. In other words, the unit 7 develops only that part of the latent image which is attributable to the influence of primary radiation. Otherwise stated, the visible image is an accurate reproduction of that portion of the latent image which is identical with an image adapted to be obtained by placing between the object 3 and the imaging chamber 4 a raster of a size matching the size of the receptor sheet 5.

An ancillary advantage of the apparatus of FIG. 1 is that the ionization chamber 11, raster 12 and amplifier 14 replace conventional dosimeters which are utilized solely to determine the quantity of radiation to which an object must be exposed. Thus, the parts 11, 12, 14 perform the dual function of furnishing signals which denote the intensity of primary radiation for the purpose of eliminating the effects of stray radiation upon the quality of developed images as well as for the purpose of enabling the control circuit 15 to interrupt the emission of X-rays when the latent image of the object is satisfactory for conversion into a visible (permanent) image.

The method and apparatus of the invention can be practiced with particular advantage for the examination of objects which produce a substantially homogeneous stray radiation. Such objects include the thorax, mamma and abdomen of a patient. However, the improved apparatus and method can be resorted to with nearly equal or identical advantage in connection with the imaging of objects which do not produce homogeneous stray radiation; in such instances, the means for ascertaining the intensity of stray radiation is somewhat more complex (e.g., it may include a full matrix of suitably distributed and oriented ionization chambers behind the receptor sheet).

FIG. 2 shows a simplified version of the apparatus of FIG. 1. The ionization chambers 10, 11, the raster 12 and the amplifiers 13, 14 and 16 are omitted. The source 17 is replaced with a manually adjustable energy source 20 provided with an adjusting knob 21 which can be manipulated to apply to the electrodes 8 and 9 a reverse potential which is proportional to the percentage of stray radiation in the total amount of radiation passing through an object and causing the formation of a latent image on the dielectric receptor sheet (not shown in FIG. 2). The potential which is applied to the electrodes 8 and 9 depends on the thickness and density of the object and can be selected in advance on the basis of empirically gathered data furnished by the manufacturer of the apparatus. For example, the manufacturer can supply one or more tables with information denoting necessary manual adjustments of the source 20 for different densities, sizes and/or thicknesses of objects; such data can be accumulated on the basis of one or more series of experiments. Alternatively, the information which is perused by the person adjusting the source 20 by way of the knob 21 can be obtained on the basis of calculations.

The apparatus of FIG. 2 exhibits the advantage that its cost is substantially lower than that of the apparatus of FIG. 1. On the other hand, the apparatus of FIG. 1 is more reliable because the necessary reverse potential which is applied to the electrodes 8 and 9 is determined automatically for each and every exposure of an object to X-rays. It can be said that the difference between the two apparatus is analogous to that between two cameras one of which is equipped with manually adjustable and the other of which is equipped with automatic exposure control means.

The improved apparatus is susceptible of many additional modifications without departing from the spirit of the invention. For example, the accuracy of determination of the intensity of stray radiation can be enhanced by equipping the apparatus of FIG. 1 with two or more pairs of ionization chambers 10, 11 (an additional pair is indicated by broken lines, as at 10' and 11'), e.g., by an entire matrix of pairs of ionization chambers. Alternatively, and as shown in FIG. 3, the apparatus of FIG. 1 can employ a single ionization chamber 111 and a disk 25 which carries one or more rasters 112 and rotates in the space between the chambers 4 (not shown) and 111. The signal at the output of the chamber 111, when the latter registers with a raster 112, is analogous to the signal at the output of the chamber 11 of FIG. 1; the signal at the output of the chamber 111, when the latter is not in register with a raster 112, is analogous to the signal at the output of the ionization chamber 10 of FIG. 1. The differential amplifier 13 (or an equivalent circuit) then serves to subtract from the intensity of a signal which is furnished by the chamber 111 while the latter is not overlapped by a raster 112 the intensity of a signal which the chamber 111 furnishes while in register with a raster 112 and to transmit a signal which is proportional to the signal at the output of the amplifier 13 of FIG. 1. The disk 25 is rapidly driven by a suitable motor M to enable the chamber 111 to furnish alternating signals of higher and lower intensity at desired intervals.

If the amplifier 14 of FIG. 1 is omitted, the ionization chamber 11 is replaced with a larger ionization chamber (as compared with the chamber 10) so that the intensity of signal at its output matches the intensity of signal at the output of the amplifier 14.

Symmetrical distribution of the chambers 10 and 11 or 10, 10' and 11, 11' with reference to the plane of the central ray 2A is advisable in connection with the making of X-ray images of certain objects, e.g., lungs. This insures that the conditions at both sides of the symmetry plane between the chambers 10, 11 are the same.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. A method of making and processing latent images of X-rayed objects on dielectric receptor sheets which are confined in the interelectrode gap of an ionography imaging chamber during exposure to object-modulated X-rays including primary radiation and stray radiation, comprising the steps of exposing a receptor sheet to object-modulated X-rays whereby said stray radiation causes the formation of a first electrostatic charge pattern and the primary radiation causes the formation of a second charge pattern on the receptor sheet, said patterns together constituting the latent image; and neutralizing the first charge pattern, which corresponds to the action of said stray radiation, during processing of the receptor sheet.

2. A method as defined in claim 1, wherein said processing includes electrophoretic conversion of said latent image into a visible image between spaced-apart electrodes in the presence of toner particles, said neutralizing step comprising applying to said electrodes a reverse potential which is at least approximately proportional to the intensity of said stray radiation.

3. A method as defined in claim 1, wherein said processing includes electrophoretic conversion of said latent image into a visible image between spaced-apart electrodes in the presence of toner particles, said neutralizing step comprising the application to said electrodes of a reverse potential which is selected by hand on the basis of thickness and/or density of the object so as to be at least approximately proportional to the intensity of said stray radiation.

4. In an apparatus for making and processing latent images of X-rayed objects on dielectric receptor sheets which are confined in the interelectrode gap of an ionography imaging chamber during exposure to X-rays issuing from a source of X-rays and penetrating through an object which is disposed between the source and the imaging chamber and causes the development of primary radiation and stray radiation whereby the influence of stray radiation results in the formation of a first charge pattern and the influence of primary radiation results in the formation of a second charge pattern, said patterns together constituting the latent image of the object on the receptor sheet, the improvement which consists in the provision of means for neutralizing said first pattern, which corresponds to the action of said stray radiation, during processing of said latent image.

5. The improvement as defined in claim 4, further comprising means for generating signals of an intensity denoting the intensity of primary radiation and control means for regulating, as a function of the intensity of said signals, the total amount of radiation to which the object is exposed.

6. The improvement as defined in claim 5, further comprising means for measuring the intensity of primary radiation including an ionization chamber disposed in the path of portions or primary and stray radiation which penetrate through and beyond said imaging chamber and a raster disposed between said chambers and arranged to absorb said portion of stray radiation, said ionization chamber constituting said signal generating means.

7. The improvement as defined in claim 4, wherein said neutralizing means includes an electrophoretic developing unit for said latent images, said unit including a pair of spaced apart electrodes defining a space for receptor sheets therebetween and said neutralizing means further comprising means for applying to said electrodes a reverse potential which is at least approximately proportional to the intensity of stray radiation.

8. The improvement as defined in claim 7, wherein said potential applying means includes an adjustable source of potential and manually operable means for adjusting said last mentioned source.

9. A method of making and processing latent images of X-rayed objects on dielectric receptor sheets which are confined in the interelectrode gap of an ionography imaging chamber during exposure to object-modulated X-rays including primary radiation and stray radiation, portions of which penetrate through and beyond the imaging chamber, comprising the steps of exposing a receptor sheet to object-modulated X-rays whereby said stray radiation causes the formation of a first electrostatic charge pattern and the primary radiation causes the formation of a second charge pattern on the receptor sheet, said patterns together constituting the latent image; measuring the intensity of said portion of stray radiation and producing a signal which is proportionate to the measured intensity of stray radiation; and neutralizing the first charge pattern during processing of the receptor sheet, including utilizing said signal to eliminate the effect of said first charge pattern upon the quality of visible image into which the latent image is converted during said processing.

10. A method of making and processing latent images of X-rayed objects on dielectric receptor sheets which are confined in the interelectrode gap of an ionography imaging chamber during exposure to object-modulated X-rays including primary radiation and stray radiation, portions of which penetrate through and beyond the imaging chamber, comprising the steps of exposing a receptor sheet to object-modulated X-rays whereby said stray radiation causes the formation of a first electrostatic charge pattern and the primary radiation causes the formation of a second charge pattern on the receptor sheet, said patterns together constituting the latent image; measuring the combined intensity of said portions of primary radiation and stray radiation; measuring the intensity of said portion of primary radiation; producing a signal which is proportional to the difference between the measured intensities, said signal being also proportional to the intensity of stray radiation; and neutralizing the first charge pattern during processing of the receptor sheet, including utilizing said signal to eliminate the effect of said first charge pattern upon the quality of visible image into which the latent image is converted during said processing.

11. A method as defined in claim 10, further comprising the steps of generating a second signal which denotes the intensity of the measured portion of primary radiation and utilizing said second signal for determination of the quantity of radiation to which the object is exposed.

12. In an apparatus for making and processing latent images of X-rayed objects on dielectric receptor sheets which are confined in the interelectrode gap of an ionography imaging chamber during exposure to X-rays issuing from a source of X-rays and penetrating through an object which is disposed between the source and the imaging chamber and causes the development of primary radiation and stray radiation whereby the influence of stray radiation results in the formation of a first charge pattern and the influence of primary radiation results in the formation of a second charge pattern, said patterns together constituting the latent image of the object on the receptor sheet, and wherein portions of said primary radiation and said stray radiation penetrate through and beyond the imaging chamber, the improvement which consists in the provision of means for measuring the intensity of said portion of stray radiation, and means for neutralizing said first pattern during processing of said latent image, said neutralizing means including means for neutralizing said first charge pattern to the extent which is at least approximately proportional to the intensity of stray radiation.

13. The improvement as defined in claim 12, wherein said measuring means comprises dosimeter means located in the path of radiation beyond said imaging chamber and means for at least intermittently intercepting said portion of stray radiation intermediate said chamber and said dosimeter means so that the latter furnishes first and second signals respectively denoting the combined intensity of said portions of primary and stray radiation and the intensity of said portion of primary radiation, and means for applying to said neutralizing means a third signal which is indicative of the difference between said first and second signals.

14. The improvement as defined in claim 13, wherein said dosimeter means comprises a first and a second ionization chamber and said intercepting means comprises a radiation absorbing raster disposed between the imaging chamber and one of said ionization chambers, said signal applying means comprising a differential amplifier having first and second inputs respectively connected to the outputs of said first and second ionization chambers.

15. The improvement as defined in claim 14, wherein said ionization chambers are identical and further comprising second amplifier means connected between said one ionization chamber and said differential amplifier, the amplification factor of said second amplifier means being proportional to the absorption factor of said raster.

16. The improvement as defined in claim 14, wherein said X-rays include a central ray and said ionization chambers are mirror symmetrical to each other with reference to said central ray.

17. The improvement as defined in claim 14, wherein said ionization chambers face said source.

18. In an apparatus for making and porcessing latent images of X-rayed objects on dielectric receptor sheets which are confined in the interelectrode gap of an ionography imaging chamber during exposure to X-rays issuing from a source of X-rays and penetrating through an object which is disposed between the source and the imaging chamber and causes the development of primary radiation and stray radiation whereby the influence of stray radiation results in the formation of a first charge pattern and the influence of primary radiation results in the formation of a second charge pattern, said patterns together constituting the latent image of the object on the receptor sheet, the improvement which consists in the provision of means for neutralizing said first pattern during processing of said latent image, including an electrophoretic developing unit for said latent images, said unit including a pair of spaced apart electrodes defining a space for receptor sheets therebetween and said neutralizing means further comprising means for applying to said electrodes a reverse potential which is at least approximately proportional to the intensity of stray radiation; means for measuring the intensity of stray radiation; and means for transmitting to said potential applying means a signal denoting the measured intensity.

* * * * *